US011207573B2

(12) United States Patent
Cleghorn et al.

(10) Patent No.: US 11,207,573 B2
(45) Date of Patent: Dec. 28, 2021

(54) STRIKING FACE OF A GOLF CLUB

(71) Applicant: Acushnet Company, Fairhaven, MA (US)

(72) Inventors: Richard L. Cleghorn, Oceanside, CA (US); Nick Frame, Vista, CA (US); Noah de la Cruz, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/520,570

(22) Filed: Jul. 24, 2019

(65) Prior Publication Data

US 2021/0023424 A1 Jan. 28, 2021

(51) Int. Cl.
*A63B 53/04* (2015.01)

(52) U.S. Cl.
CPC ..... *A63B 53/0466* (2013.01); *A63B 53/0416* (2020.08); *A63B 53/0458* (2020.08)

(58) Field of Classification Search
CPC ..... A63B 53/0466; A63B 53/0416; A63B 53/0458; A63B 53/0408
See application file for complete search history.

(56) References Cited

U.S. PATENT DOCUMENTS 6,319,150 B1 11/2001 Werner
6,478,693 B2 * 11/2002 Matsunaga ..... A63B 53/04 473/345
6,623,377 B2 9/2003 Evans
6,652,391 B1 11/2003 Kubica
6,904,663 B2 * 6/2005 Willett ..... A63B 53/0466 29/557
6,997,820 B2 2/2006 Willett
7,041,003 B2 * 5/2006 Bissonnette ..... G01N 29/045 473/329
7,137,907 B2 11/2006 Gibbs
7,442,132 B2 * 10/2008 Nishio ..... A63B 53/0466 473/342
7,614,964 B2 * 11/2009 Matsunaga ..... A63B 53/0466 473/342
7,753,808 B2 * 7/2010 Matsunaga ..... A63B 53/0466 473/342
7,993,214 B2 * 8/2011 Hirano ..... A63B 53/0466 473/329
8,070,623 B2 12/2011 Stites
(Continued)

FOREIGN PATENT DOCUMENTS

JP 2006149449 A * 6/2006 ..... A63B 53/0466

*Primary Examiner* — Stephen L Blau
(74) *Attorney, Agent, or Firm* — Kristin D. Wheeler

(57) ABSTRACT

A golf club head with improved striking face performance is disclosed herein. More specifically, the present invention discloses a golf club head having a striking face portion with a back surface provided with multiple constant thickness zones and multiple transition zones on a back surface of the striking face portion. Preferably, at least three constant thickness zones are provided in the thickened central region of the striking face portion encompassed by an intermediate transition zone and an outer perimeter region encompassing the intermediate transition zone comprising at least four outer perimeter constant thickness zones. Preferably, the thickened central region and the intermediate transition region mimic the shape of the face perimeter of the striking face portion of the golf club head.

23 Claims, 9 Drawing Sheets

(56) References Cited

U.S. PATENT DOCUMENTS

| | | | | |
|---|---|---|---|---|
| 8,214,992 | B2 * | 7/2012 | Hirano | A63B 53/0466 29/412 |
| 8,272,975 | B2 * | 9/2012 | Morin | A63B 60/00 473/342 |
| 8,277,336 | B2 * | 10/2012 | Hirano | A63B 53/0466 473/345 |
| 8,808,107 | B2 * | 8/2014 | Abe | A63B 53/10 473/342 |
| 8,814,724 | B2 * | 8/2014 | Kato | A63B 53/04 473/346 |
| 8,845,454 | B2 | 9/2014 | Boyd et al. | |
| 9,101,809 | B2 * | 8/2015 | Gibbs | A63B 53/02 |
| 9,999,811 | B2 * | 6/2018 | Boyd | A63B 53/0466 |
| 2006/0094531 | A1 * | 5/2006 | Bissonnette | A63B 60/42 473/329 |
| 2010/0234135 | A1 * | 9/2010 | Matsunaga | A63B 53/0466 473/342 |
| 2012/0149495 | A1 * | 6/2012 | Wada | A63B 53/0466 473/349 |
| 2012/0283037 | A1 * | 11/2012 | Curtis | A63B 53/0466 473/330 |
| 2015/0119166 | A1 * | 4/2015 | Deshmukh | A63B 53/0466 473/349 |
| 2016/0067561 | A1 * | 3/2016 | Golden | A63B 60/00 473/342 |
| 2021/0046361 | A1 * | 2/2021 | Morales | A63B 53/0462 |

* cited by examiner

STRIKING FACE OF A GOLF CLUB

FIELD OF THE INVENTION

The present invention relates to an improved striking face of a golf club head. More specifically, the present invention relates to a golf club head having a striking face portion with a back surface provided with multiple constant thickness zones and multiple transition zones on a back surface of the striking face portion.

BACKGROUND OF THE INVENTION

The game of golf has always been closely linked to the equipment used to play the game itself. Although the actual game of golf has not changed much since its inception in the early days of Scotland, the equipment used to play the game of golf has made significant transformations. Although it is debatable which of the numerous golf equipments have changed the most since the early days of golf, it is hard to argue that the current state of metalwood type golf clubs is not a dramatic deviation from the persimmon woods originally used during the early stages of the game of golf.

Metalwood clubs, based on their inherent design, improve upon the performance of a persimmon wood type golf club head by creating a hollowed metallic shell; which in turn, may drastically increase the coefficient of restitution of the golf club head by allowing the striking face to deflect during impact. In addition to increasing the coefficient of restitution, metalwood type golf club heads have made the game of golf easier for the average golfer by increasing the moment of inertia of the golf club head, which results from the increase in size while maintaining the stability of the golf club through impact.

Despite all the performance gains above, golf club designers have pushed the performance boundary even further by varying the thicknesses of the back of the striking face of the golf club head. Varying the thickness of the back portion of the striking face of the golf club head improves the performance of the golf club head by adjusting the flexural stiffness of the striking face of the golf club head to strategically improve the size and shape of the sweet spot on the striking face; wherein the sweet spot is defined as the portion of the striking face capable of achieving a high coefficient of restitution.

U.S. Pat. No. 6,319,150 illustrates one of the earlier attempts at varying the thickness of the face wall to maximize face strength with minimum face mass. U.S. Pat. No. 6,319,150 provides a golf club that increases the maximum size of the hitting face of the golf club that is usable by having a varying thickness to allow for additional weight to be saved and placed strategically at alternative locations to improve the moment of inertia of the golf club head.

Although these early attempts at adjusting the thickness of the striking face of the golf club head are admirable in providing a foundation for the future development of this concept, most of them do not fully realize the performance benefits that can be achieved by optimizing the size, shape, and geometry of the variable thickness profile at the rear of the striking face based on the size, shape, and geometry of the striking face. U.S. Pat. No. 6,652,391 shows one attempt at varying the size, shape, and geometry of the striking face of the golf club head in an attempt to improve the performance, but it fails to correlate it to the size, shape, and geometry of the striking face itself. More specifically, U.S. Pat. No. 6,652,391 discloses a front wall that varies in thickness and has a bulging area of increased thickness on its inner surface. The bulging area of increased thickness includes a generally ring shaped mass that projects rearwardly from the front wall. A generally cone shaped mass, that also projects rearwardly from the front wall, may be located inside the ring shaped mass.

U.S. Pat. No. 6,997,820 provides another example of an alternative attempt to adjust the size, shape, and geometry of the thickness geometry behind a striking plate to further improve upon the fundamental concept of a golf club having a variable thickness face. In doing so, U.S. Pat. No. 6,997,820 discloses a face plate having a vertical zone of increased thickness and a central region having a reduced thickness. An upward extension of the vertical zone comprises divergent segments separated by an upper region of reduced thickness.

U.S. Pat. No. 7,137,907 provides a further example of another completely different geometry used to adjust the performance of a striking face of a golf club head. More specifically, U.S. Pat. No. 7,137,907 discloses a face insert having an interior surface with a first thickness section and a second thickness region. The first thickness section preferably has a thickness that is at least 0.025 inch greater than the thickness of the second thickness region.

U.S. Pat. No. 6,623,377 provides yet another example of an attempt to adjust the performance of the golf club head by changing the thickness of the striking face. More specifically, U.S. Pat. No. 6,623,377 discloses a golf club head having a striking plate with regions of varying thickness having a central region of a first thickness that is thicker than the thickness range of any other region. The thickness of the regions decreases outward from the center.

Despite numerous attempts at adjusting the size, shape, and geometry of the rear surface of the striking face of a golf club head, none of the above mentioned patents have investigated the relationship between the size, shape, and geometry of the striking face as it relates to the geometry of the overall geometry of the striking face itself. A golf club with an optimized striking face in terms of its size, shape, and geometry may greatly improve the coefficient of restitution of the golf club head as well as increase the sweet spot of the golf club head.

Hence, as it can be seen from above, despite all the advancement in golf club technology, the current art has not carefully examined the relationship between the size, shape, and geometry of the striking face as it relates to the size, shape, and geometry of the variable face thickness profile behind the striking face. The current art, despite its numerous attempts at varying the thickness of the striking face, falls short by using random geometries that do not completely optimize the performance capabilities of a golf club head as it relates to the striking face itself. Ultimately, it can be seen from above that there is a need in the art for a golf club head that has a variable thickness geometry that optimizes the size, shape, and geometry of the various thickness levels as it relates to the striking face of the golf club head itself.

BRIEF SUMMARY OF THE INVENTION

One aspect of the present invention is a golf club head having a crown, a sole, and a skirt. A golf club head comprises a striking face portion located at a frontal portion of the golf club head adapted to strike a golf ball, the striking face portion has a face perimeter and a back surface, and a body portion connected to an aft portion extending from the face perimeter of the striking face portion. The striking face portion further comprises a thickened central region having a central perimeter and at least three central constant thickness zones provided in the central region within the central perimeter, an intermediate transition region immediately encompassing the thickened central region and having an intermediate transition perimeter, and an outer perimeter region immediately encompassing the intermediate transition region and having at least four outer perimeter constant thickness zones.

The golf club head may further comprise at least two central transition zones separating the at least three central constant thickness zones. The at least three central constant thickness zones may extend vertically within the thickened central region. The at least three central constant thickness zones include a center constant thickness zone with a center constant thickness zone perimeter having vertical boundaries that are curved to form a substantially hourglass shape. The at least four outer perimeter constant thickness zones are provided extending from the intermediate transition perimeter towards a crown region, a sole region, a heel region and a toe region of the club head to the face perimeter. The at least four outer perimeter constant thickness zones may be separated by at least four outer perimeter transition zones extending from the intermediate transition perimeter towards the face perimeter.

In another embodiment, the two central transition zones separating the at least three constant central thickness zones may have a width of about 1 mm to about 4 mm. The thickened central region may comprise between about 10 to about 20 percent of the overall striking face portion enclosed by the face perimeter.

The at least one of the at least three central constant thickness zones may form a center constant thickness zone that includes the thickest part of the striking face portion. The center constant thickness zone is about 4 to about 10 percent of the overall striking face portion. The encompassing intermediate transition zone may have a width and the width adjacent the crown portion is greater than the width adjacent the sole portion. The outer perimeter constant thickness zones and outer perimeter transition zones may radiate outwardly from the encompassing intermediate transition zone to the face perimeter. The outer perimeter transition zones may have a width of at least 4 mm adjacent to the encompassing intermediate transition zone. The outer perimeter constant thickness zones and outer perimeter transition zones may have substantially straight edges. The edges of the outer perimeter constant thickness zones and outer perimeter transition zones may extend outward at about a 30 to about a 60 degree angle from an orthogonal plane. The face perimeter has a shape and the thickened central region may substantially mimic the shape of the face perimeter and may be scaled about the center of the striking face portion.

In another aspect of the invention, the golf club head may comprise a striking face portion located at a frontal portion of the golf club head adapted to strike a golf ball, said striking face portion having a face perimeter and a rear surface, a body portion connected to an aft portion extending from the face perimeter of the striking face portion, at least seven constant thickness zones and at least five transition zones provided on the rear surface of the striking face portion.

At least three of the constant thickness zones may be provided centrally on the rear surface of the striking face portion in a thickened central region. Edges may be provided on the at least three constant thickness zones and at least two edges may be oriented substantially vertically and are substantially straight. The at least three constant thickness zones extend from a crown portion of the striking face portion to a sole portion of a striking face portion. The at least three constant central thickness zones may be provided in a thickened central region of the striking face portion and encompassed by an intermediate transition zone. The at least three constant central thickness zones may be separated by two central transition zones. The thickened central zones may comprise between about 10 to about 20 percent of the overall striking face portion enclosed by the face perimeter. At least one of the at least three central constant thickness zones may form a center constant thickness zone that includes the thickest part of the striking face portion. The center constant thickness zone may be about 4 to about 10 percent of the overall striking face portion enclosed by the face perimeter. The encompassing intermediate transition zone may have a width and the width adjacent the crown portion may be greater than the width adjacent the sole portion. An outer perimeter zone may be provided outside the encompassing intermediate transition zone, wherein the outer perimeter zone may provide at least four outer perimeter constant thickness zones and at least four outer perimeter transition zones separating the outer perimeter constant thickness zones.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
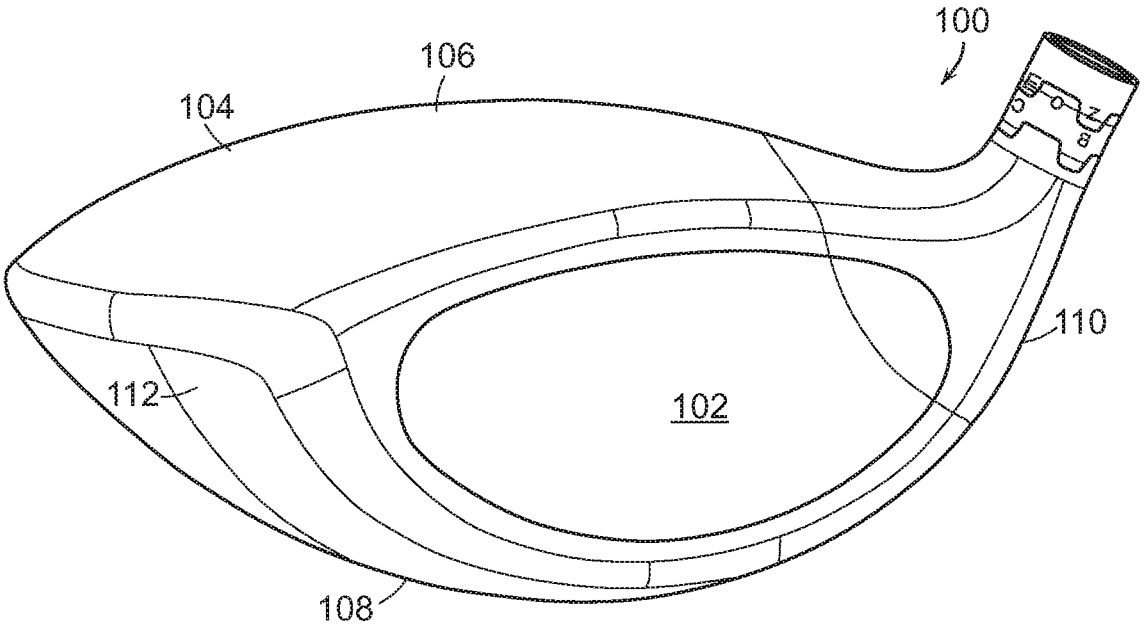
FIG. 1 shows a perspective view of a golf club head in accordance with an exemplary embodiment of the present invention.

FIG. 1 of the accompanying drawings shows a perspective view of a golf club head 100 in accordance with an exemplary embodiment of the present invention. The golf club head 100 shown in FIG. 1 may generally have a striking face portion 102 located at a frontal portion of the golf club head 100 that is adapted to strike a golf ball (not shown) and a body portion 104 that is connected to an aft portion of the striking face portion 102. The body portion 104 of the golf club head 100 may generally have a crown portion 106, a sole portion 108, a heel portion 110 and a toe portion 112 to round up the various components of the golf club head 100. Although not externally visible, the striking face portion 102 of the golf club head 100 may generally have a unique internal geometry that varies the thickness of the striking face portion 102 in a way that is related to the size, shape, and geometry of the striking face portion 102 itself.

Figure 2:
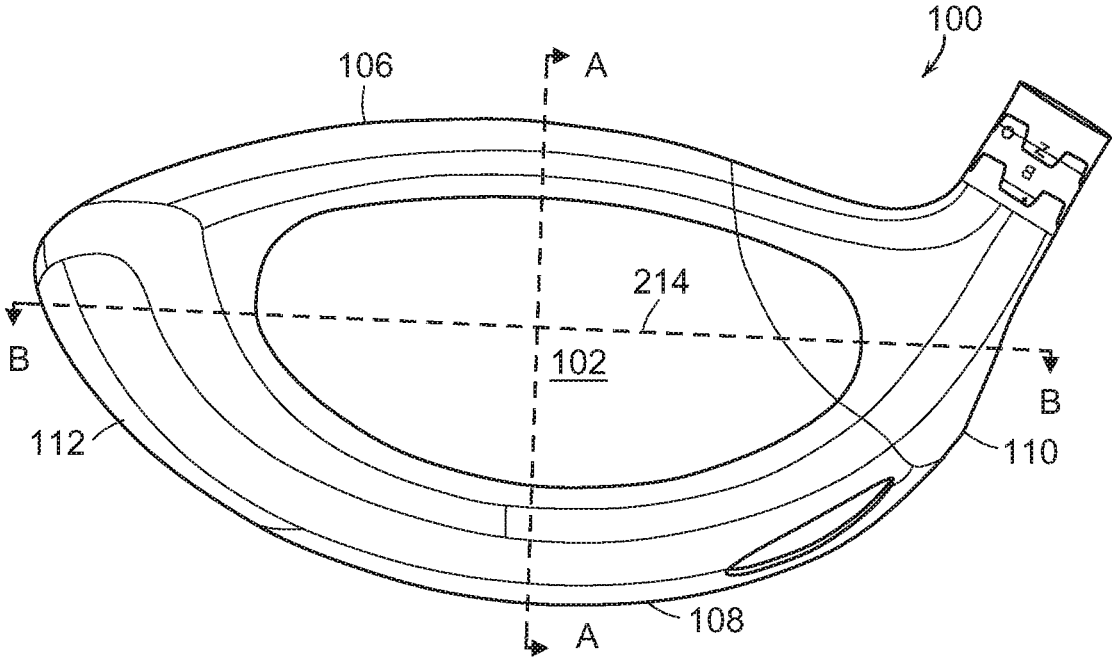
FIG. 2 shows a frontal view of a golf club head in accordance with an exemplary embodiment of the present invention.

In order to more closely examine the internal geometry of the striking face portion 102, a cross-sectional view of the golf club head 100 must be first defined. FIG. 2 of the accompanying drawings showing a frontal view of a golf club head 100 provides an easy methodology to define the necessary cross-sectional views. More specifically, FIG. 2 shows cross-sectional line A-A spanning vertically across the geometric center 214 of the striking face 102 in a crown to sole direction. In addition to the above, FIG. 2 also shows cross-sectional line B-B spanning horizontally across the geometric center 214 of the striking face 102 in a heel to toe direction. It is worthwhile to mention here that the geometric center 214 of the striking face 102 may generally refer to a point on the surface of the striking face 102 that depicts the central point within the striking face 102. As is understood in the art, the golf club head 100 has a crown portion 106, a sole portion 108, a heel portion 110 and a toe portion 112.

Figure 3:
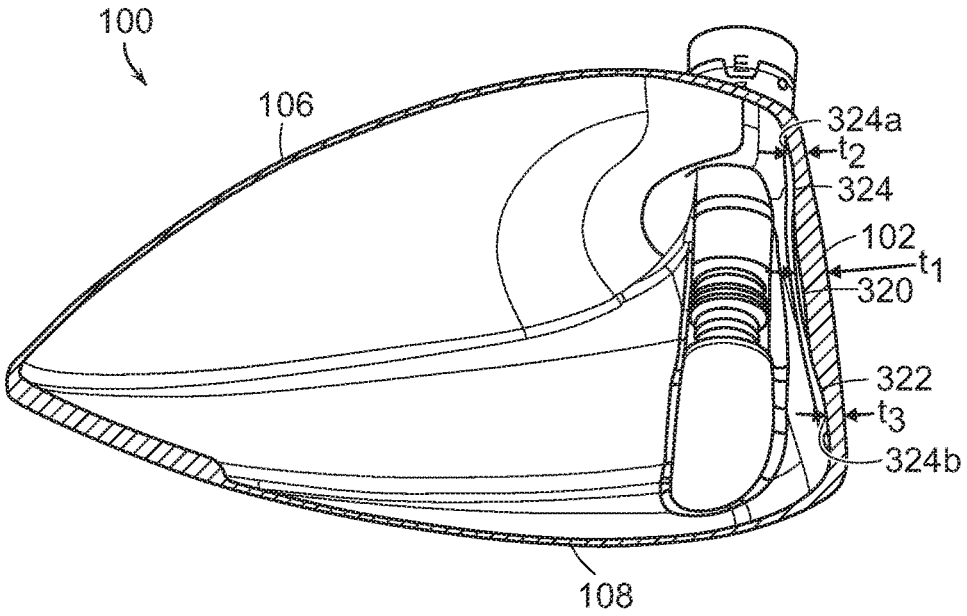
FIG. 3 shows a cross-sectional view of a golf club head in accordance with an exemplary embodiment of the present invention taken along cross-sectional line A-A shown in FIG. 2.

FIG. 3 of the accompanying drawings shows a cross-sectional view of the golf club head 100 shown in FIG. 2 taken along cross-sectional line A-A. This cross-sectional view of the golf club head 100 shown in FIG. 3 allows the variable thickness geometry behind the striking face 102 to be shown. More specifically, the striking face 102 may generally have a thickened central region 320, an intermediate transition region 322, and an outer perimeter region 324. The thickened central region 320, as shown in this current exemplary embodiment, may generally have a maximum thickness $t_1$ of greater than about 2.5 mm, more preferably a thickness of about 3 mm to about 4.5 mm, and most preferably greater than or equal to about 3.2 mm. The intermediate transition region 322, as shown in this current exemplary embodiment, generally gradually decreases in thickness to the outer perimeter region 324.

The outer perimeter region 324 may also not be symmetrical in the vertical direction. The upper outer perimeter region 324*a* adjacent the crown portion 306 of golf club head 100 may generally be thicker than the lower outer perimeter region 324*b* adjacent to the sole portion 108 of the golf club head 100. More specifically, the thickness $t_2$ of the upper outer perimeter region 324*a* near the crown portion 106 of the striking face 102 may be about 1.7 mm to about 2.8 mm. The thickness $t_3$ of the lower outer transition region 324*b* near the sole portion 108 of the striking face 102 may be about 1.7 mm to about 2.8 mm. Preferably, $t_1>t_2\leq t_3$. Based on the various thicknesses $t_1$, $t_2$ and $t_3$ mentioned above, it can be seen that the striking face 102 shown in this exemplary embodiment of the present invention may have a thicker upper portion, a thinner lower portion, combined with a thickened central region 320 to help create a geometry that optimizes the performance of the golf club head 100.

Figure 4:
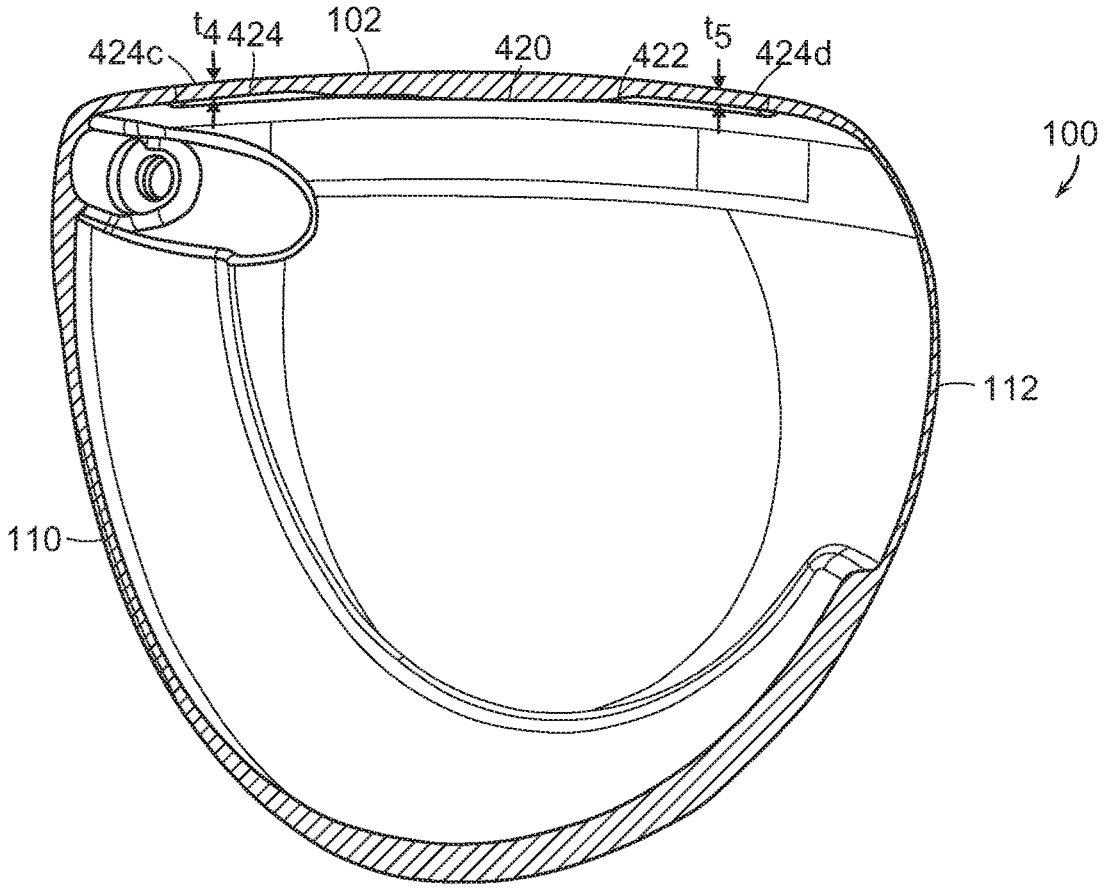
FIG. 4 shows a cross-sectional view of a golf club head in accordance with an exemplary embodiment of the present invention taken along cross-sectional line B-B shown in FIG. 2.

FIG. 4 of the accompanying drawings shows a cross-sectional view of a golf club head 100 in accordance with an exemplary embodiment of the present invention, taken across a horizontal cross-sectional line B-B shown in FIG. 2. Similar to the previous cross-section shown in FIG. 3, FIG. 4 shows the striking face 102 of the golf club head 100 having a thickened central region 420, an intermediate transition region 422, and an outer perimeter region 424. Although FIG. 3 showed the upper outer perimeter region 324*a* adjacent the crown portion 106 of the striking face 102 being thicker than the lower outer perimeter region 324*b* adjacent the sole portion 108 of the striking face 102, the same phenomenon is not necessarily apparent along the heel to toe direction. More specifically, the thickness of the heel outer perimeter region 424*c* adjacent the heel portion 110 of the striking face 102 may have a thickness $t_4$ of about 1.7 mm to about 2.8 mm, preferably 2 mm. The toe outer perimeter region 424*d* adjacent the toe portion 112 of the striking face 102 may have a thickness $t_5$ of about 1.7 mm to about 2.8 mm, preferably 2.1 mm. Preferably, $t_4$ and $t_5$ are a substantially similar thickness. Additionally, preferably $t_1>t_2$ and $t_3\geq t_4$ and $t_5$. It will be appreciated that $t_4$ and $t_5$ are shown in FIGS. 5C, 6C, 7C, 8C, 9C, 10C and 11C.

Figure 5A:
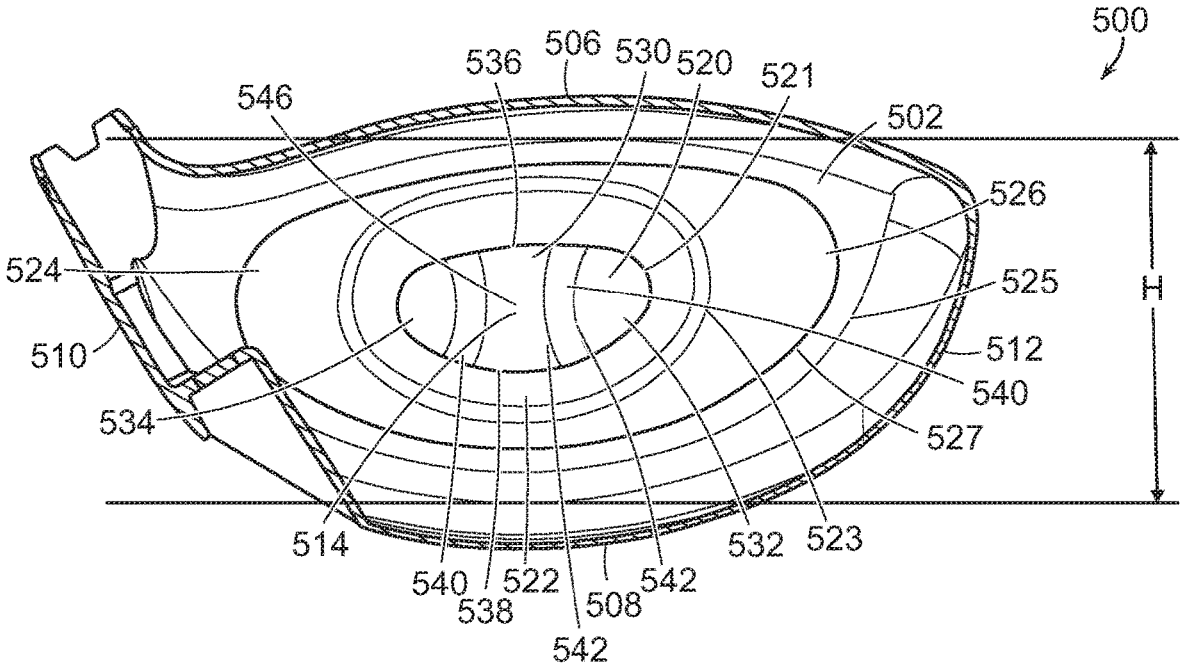
FIG. 5A shows a rear view of a cut-open golf club head that illustrates the striking face in accordance with an exemplary embodiment of the present invention.
Figure 5B:
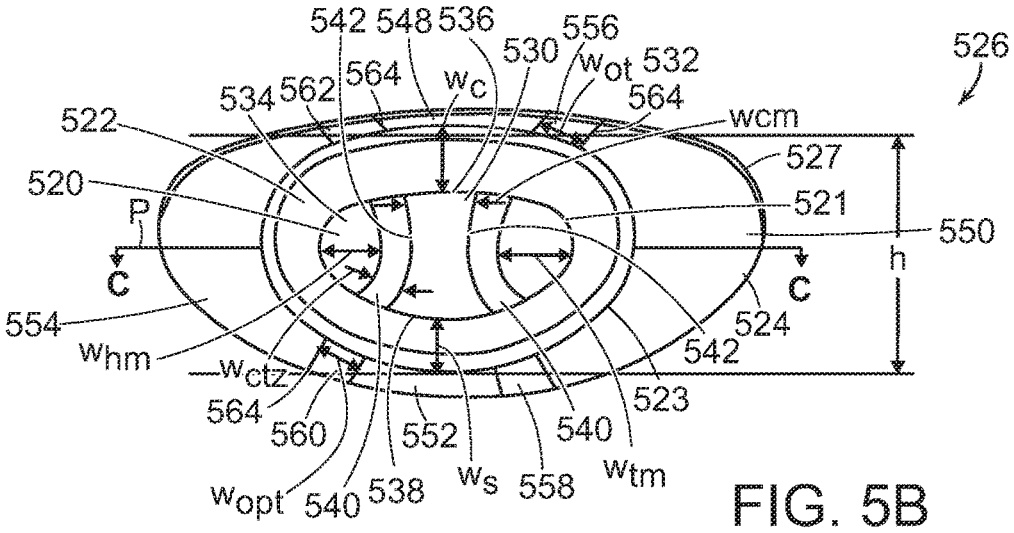
FIG. 5B shows a rear view of the striking face insert of FIG. 5A taken along cross-sectional line B-B that illustrates the striking face in accordance with an exemplary embodiment of the present invention.
Figure 5C:
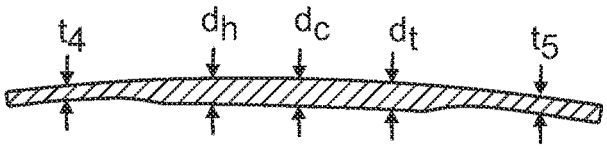
FIG. 5C shows a cross-sectional view of the striking face insert of FIG. 5B taken along cross-sectional line C-C that illustrates the striking face in accordance with an exemplary embodiment of the present invention.

FIGS. 5A-C provide the final piece of the puzzle to clearly define the size, shape, and geometry of the striking face 502 in accordance with an exemplary embodiment of the present invention. It will be appreciated from the prior embodiments that the golf club head 500 generally has a crown portion 506, a sole portion 508, a heel portion 510 and a toe portion 512. More specifically, FIGS. 5A-C of the accompanying drawings show a rear view of a golf club head 500 that has been cut open to illustrate the rear portion of the striking face 502. Striking face 502, as shown in FIGS. 5A-C, may generally have a thickened central region 520 having a central perimeter 521, an intermediate transition region 522 having an intermediate transition perimeter 523, and an outer perimeter region 524 having an outer perimeter 525. It should be noted that the length of the outer perimeter 525 shown in this current exemplary embodiment of the present invention may generally be equivalent to the length of the perimeter of the striking face 502. Hence, the term striking face perimeter 525 may be used interchangeably with the outer perimeter 525 within the context of this application without departing from the scope and content of the present invention. This embodiment in FIGS. 5A-C also shows face insert 526 having boundary 527. It will be appreciated that this boundary 527 may be within the outer perimeter region 524 as shown, or may be provided elsewhere on the striking face 502.

The boundaries of the face perimeter 525, as shown in the current exemplary embodiment of the present invention in FIGS. 5A-C may generally be difficult to visually define from the back view of the striking face 502. Hence, it is worthwhile to take the time here and clearly define the boundaries of the face perimeter 525, as it is used to help define the size, shape, and geometry of the thickened central portion 520 of striking face 502. Face perimeter 525 may generally be defined as the boundary of the frontal striking portion of the striking face 502, with its boundaries defined by the radius of curvature that substantially deviates from the frontal planar striking surface of the striking face 502. Because the hosel portion of the striking face 502 may not contain a radius of curvature that substantially deviates from the planar striking surface, that portion of the face perimeter 525 may generally be estimated by a smooth curvature that completes the definable terminal ends of the face perimeter 525.

Now that the boundary of the face perimeter 525 has been established, the relationship between the face perimeter 525 and the central perimeter 521 may be defined. As previously stated, the size, shape, and geometry of the thickened central region 520 may be substantially similar to the size, shape, and geometry of the striking face 502, and their relationship relative to one another helps quantify the performance gains of the golf club head. In addition to the similarity in size, shape, and geometry between the thickened central region 520 and the striking face 502, the intermediate transition region 522 may also have a size, shape, and geometry that are substantially similar to the striking face 502.

The area of the striking face 502 is about 3000 $mm^2$ to about 4000 $mm^2$, more preferably about 3300 $mm^2$ to about 3700 $mm^2$. The size of the thickened central region 520 is also important to the performance of the striking face 502 of the golf club head. More specifically, as it can be seen in FIGS. 5A-C, it is generally desirable to have the size of the thickened central region 520 be significantly smaller than the overall size of the striking face 502 that is defined by the face perimeter 525. The size of the thickened central region 520, defined by the length of the central perimeter 521 may generally be between about 10% to about 40% of the size of the striking face 502, more preferably about 10% to about 20% of the striking face 502, and most preferably about 15% of the striking face 502.

Finally, it is worth recognizing here that the rear view of the striking face 502 shown in FIGS. 5A-C shows a relationship of the geometric shapes of the thickened central region 520 and the striking face 502. More specifically, FIGS. 5A-C of the accompanying drawings show that both the thickened central region 520 and the intermediate transition region 522 have a geometry that substantially resembles the geometry of the face perimeter 525. Alternatively speaking, the central perimeter 521 and the intermediate transition perimeter 523 may all form a geometric shape that is substantially similar to the geometric shape of the face perimeter 525. It is important to recognize here that having the thickened central region 520 take on a shape that substantially resembles the geometry of the entire striking face 502 is beneficial to the performance of the golf club head because it allows for a more uniform deflection of the striking face 502 along all directions to create a larger "sweet spot". "Sweet spot", although commonly used within the golf industry as a desirable indicator of golf club performance, is seldom defined in a way that is easily quantifiable. Hence, in an attempt to quantify the performance gains of the current invention by having such an improved geometry of the thickened central region 520, the "sweet spot" is defined as the portion of said striking face 502 that is capable of achieving at least 98% of a maximum ballspeed that can result from an impact with a golf ball.

It will be appreciated in view of embodiment of FIGS. 5A-C, thickened central region 520 features three central constant thickness zones 530, 532 and 534. Preferably, the three central constant thickness zones 530, 532 and 534 extend vertically from a top edge 536 to a bottom edge 538 of the thickened central region 520. It will be appreciated that at least one of the at least three central constant thickness zones 530, 532 and 534 includes the thickest part of the striking face 502. Preferably, the center constant thickness zone 530 includes the thickest part of the striking face 502. As shown, preferably the center constant thickness zone 530 is substantially centered on face center 514 and is sized to be about 4% to about 10%, more preferably about 7% of the overall face area enclosed by the face perimeter 525. Moreover, the center constant thickness zone 530 has a thickness $d_c$ of greater than about 2.5 mm, preferably about 3 mm to about 4.5 mm, more preferably greater than or equal to 3.2 mm. Moreover, the toe constant thickness zone 532 has a thickness $d_t$, of greater than about 2.5 mm, preferably about 3 mm to about 4 mm, more preferably greater than or equal to 3.2 mm. Additionally, the heel constant thickness zone 534 has a thickness $d_h$ of greater than about 2 mm, preferably about 2.5 mm to about 3.5 mm, more preferably greater than or equal to 2.5 mm. Preferably, $d_c > d_t \geq d_h$. In this particular embodiment shown, the center constant thickness zone 530 has a thickness $d_c$ of about 3.7 mm, the toe constant thickness zone 532 has a thickness $d_t$ of about 3.5 mm and the heel constant thickness zone 534 has a thickness $d_h$ of about 3.2 mm. Moreover, it will be appreciated that each central constant thickness zone 530, 532 and 534 has a maximum width. Preferably, the center constant thickness zone 530 has a maximum width $w_{cm}$ of about 3 mm to about 13 mm, the toe constant thickness zone 532 a maximum width $w_{tm}$ of about 4 mm to about 14 mm, and the heel constant thickness zone 534 a maximum width $w_{hm}$ of about 4 mm to about 14 mm. Preferably, $w_{tm} > w_{cm} \geq w_{hm}$.

The central constant thickness zones 530, 532 and 534 are separated by two central transition zones 540. The central transition zones 540 may have a maximum width $w_{ctz}$ between about 1 and about 4 mm, and may either be a constant width, as shown, or alternatively, may have a variable width along their vertical length. Preferably, as shown, the central transition zones 540 extend from the top edge 536 to the bottom edge 538 of the thickened central region 520. Moreover, in this preferred embodiment the center constant thickness zone 530 has vertical boundaries 542 that are curved to form a substantially hourglass shape for the center constant thickness zone 530. Preferably, the horizontal centers of the two outer central thickness zones 532 and 534 are located within about a 0.5 inch of the face center 514. It will be appreciated that the vertical boundaries 542 being curved result in the central transition zones 540 also being curved in shape as they are shown with a constant width $w_{ctz}$. As discussed previously, the thickened central region 520 has a geometric shape that substantially resembles or mimics the geometry of the striking face perimeter 525 and is scaled about the geometric center 514 of the striking face 502. In this current exemplary embodiment of the present invention shown in FIGS. 5A-C, it can be seen that although the geometry of the central perimeter 521 of the thickened central region 520 may not be identical to the face perimeter 525 of the striking face 502, it can still be considered to be substantially resembling without departing from the scope and content of the present invention. More specifically, the term "substantially similar" as defined by the current invention does not require one hundred percent congruence, but only that the shapes loosely resemble one another.

It will be appreciated that the central thickened region 520 with the central constant thickness zones 530, 532 and 534 balances CT across the striking face 502. For example, preferably the CT at the toe and heel are within 1% of the CT at the center of the thickened central region 520. In this example, the center constant thickness zone 530 has a $CT_c$ of about 245, while the toe constant thickness zone 532 has a $CT_t$ of about 245, and the heel constant thickness zone 534 has a $CT_h$ of about 244.

The intermediate transition region 522 encompasses the thickened central region 520 and has an intermediate transition perimeter 523 and an outer perimeter region 524 encompassing the intermediate transition region 522. As shown, the encompassing intermediate transition region 522 may have a width w and the width $w_c$ adjacent the crown portion 506 may be greater than the width $w_s$ adjacent the sole portion 508. For example, the intermediate transition region 522 may have a width $w_c$ adjacent the crown portion 506 of about 4 to about 10 mm and a width $w_s$ adjacent the sole portion 508 of about 4 to about 10 mm. As discussed above, the intermediate transition region 522 has a geometric shape that also substantially resembles or mimics the geometry of the striking face perimeter 525. It will be appreciated from FIGS. 5A-C that the intermediate transition region 522 has a height h that is about 50 to 90%, more preferably 60 to 80%, of the overall height H of the striking face 502. Moreover, the center 546 of the intermediate transition region 522 is translated upward relative to face center 514 by about 15%, preferably by about 7 mm. This translation of the intermediate transition zone 522 upward assists in balancing the stress on the striking face 502 between high and low hits on the striking face 502.

In the embodiment of FIGS. 5A-C, the outer perimeter region 524 has four outer perimeter constant thickness zones 548, 550, 552, 554 separated by outer perimeter transition zones 556, 558, 560, 562 extending from the intermediate transition zone 522 to towards the face perimeter 525. The outer perimeter transition zones 556, 558, 560, 562 have a width $w_{opt}$ immediately adjacent the intermediate transition region 523 of about 1 mm to about 7 mm, preferably about 3 mm to about 6 mm, more preferably at least 4 mm. It will be appreciated that the outer perimeter transition regions 556, 558, 560, 562 may diverge and increase in width as they extend to the face perimeter 525 of the striking face 502, alternatively they may be a constant width. Still more preferably, the outer perimeter transition regions 556, 558, 560, 562 may be an extension of the central transition zones 540 across the striking face 502. Preferably, the outer perimeter constant thickness zones 548, 550, 552, 554 are provided extending from the intermediate transition perimeter 523 towards a crown portion 506, a sole portion 508, a heel portion 510 and a toe portion 512 of the club head 500 to the face perimeter 525. The outer perimeter constant thickness zones 548, 550, 552, 554 and outer perimeter transition zones 556, 558, 560, 562 radiate outwardly from the encompassing intermediate transition zone 522 to the face perimeter 525. As shown, the outer perimeter constant thickness zones and outer perimeter transition zones have substantially straight edges 564. The edges 564 of the outer perimeter constant thickness zones 548, 550, 552, 554 extend outward to the face perimeter 525 at about a 30 to about a 60 degree angle from an orthogonal plane P, more preferably at about a 45 degree angle from an orthogonal plane P. The four outer perimeter constant thickness zones 548, 550, 552, 554 optimize stress on the striking face 502 for improved durability.

Although four outer perimeter constant thickness zones 548, 550, 552, 554 in the outer perimeter region are shown and described in this embodiment, it will be appreciated that either more or less outer perimeter constant thickness zones may be provided in the outer perimeter region 524. It will also be appreciated that the number of outer perimeter constant thickness zones will generally be equal to the number of outer perimeter transition zones 556, 558, 560, 562. For example, 2 and 2, or as shown in FIGS. 5A-C, 4 and 4, or 8 and 8. In another embodiment, the striking face 502 has at least a total of seven constant thickness zones and at least five transition zones provided on the rear surface of the striking face 502. Alternatively, it will be appreciated that the outer perimeter region 524 may be a region of generally constant thickness.

Figure 6A:
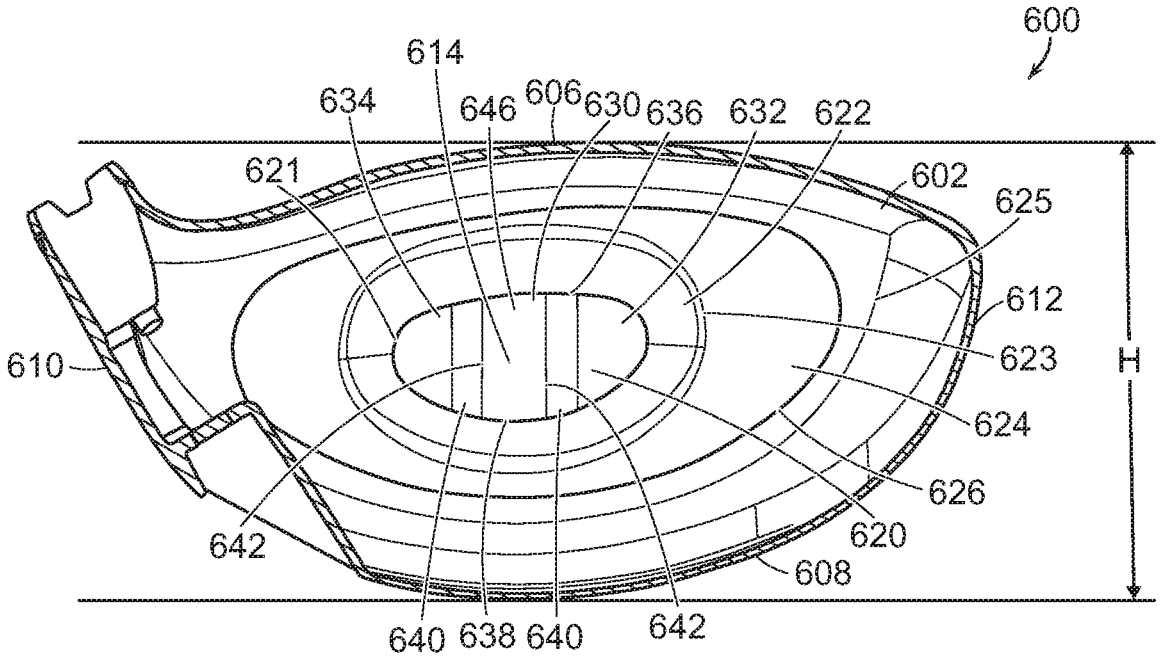
FIG. 6A shows a rear view of a cut-open golf club head that illustrates the striking face in accordance with another exemplary embodiment of the present invention.
Figure 6B:
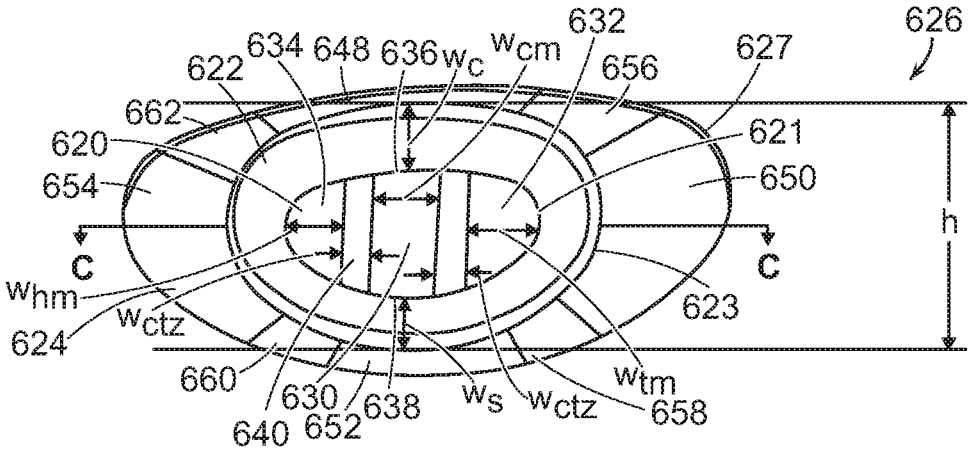
FIG. 6B shows a rear view of the striking face insert of FIG. 6A taken along cross-sectional line B-B that illustrates the striking face in accordance with an exemplary embodiment of the present invention.
Figure 6C:
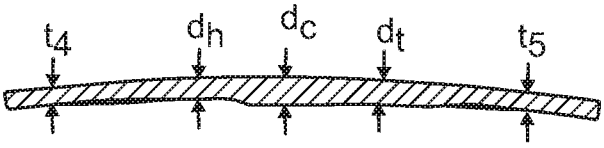
FIG. 6C shows a cross-sectional view of the striking face insert of FIG. 6B taken along cross-sectional line C-C that illustrates the striking face in accordance with an exemplary embodiment of the present invention.

FIGS. 6A-C of the accompanying drawings show another embodiment of the present invention. A golf club head 600 has been cut open to illustrate the rear portion of the striking face 602. It will be appreciated from the prior embodiments that the golf club head 600 generally has a crown portion 606, a sole portion 608, a heel portion 610 and a toe portion 612. Striking face 602, as shown in FIGS. 6A-C, may generally have a thickened central region 620 having a central perimeter 621, an intermediate transition region 622 having an intermediate transition perimeter 623, and an outer perimeter region 624 having an outer perimeter 625. As shown previously, the face insert 626 has an outer boundary 627. Thickened central region 620 features three constant thickness zones 630, 632, 634. Preferably, the three constant thickness zones 630, 632, 634 extend vertically from a top edge 636 to a bottom edge 638 of the thickened central region 620. It will be appreciated that at least one of the at least three central constant thickness zones 630, 632, 634 includes the thickest part of the striking face 602. Preferably, the center constant thickness zone 630 includes the thickest part of the striking face 602. The thickened central region 620 comprise between about 10% to about 20%, more preferably about 15%, of the overall striking face 602 enclosed by the face perimeter 625. As shown, preferably the center constant thickness zone 630 is horizontally centered on face center 614 and is sized to be about 5% to about 10%, more preferably about 7% of the overall face area defined by the face perimeter 625. Moreover, the center constant thickness zone 630 has a thickness $d_c$ of greater than about 2.5 mm, preferably about 3 mm to about 4.5 mm, more preferably greater than or equal to 3.2 mm. Moreover, the toe constant thickness zone 632 has a thickness $d_t$, of greater than about 2.5 mm, preferably about 3 mm to about 4 mm, more preferably greater than or equal to 3.2 mm. Additionally, the heel constant thickness zone 634 has a thickness $d_h$ of greater than about 2.0 mm, preferably about 2.4 mm to about 3.4 mm, more preferably greater than or equal to 2.5 mm. Preferably, $d_c > d_t \geq d_h$. In this particular embodiment shown, the center constant thickness zone 630 has a thickness $d_c$ of about 3.6 mm, the toe constant thickness zone 632 has a thickness $d_t$ of about 3.3 mm and the heel constant thickness zone 634 has a thickness $d_h$ of about 2.7 mm. Moreover, it will be appreciated that each central constant thickness zone 630, 632 and 634 has a maximum width. Preferably, the center constant thickness zone 630 has a maximum width $w_{cm}$ of about 3 mm to about 13 mm, the toe constant thickness zone 632 a maximum width $w_{tm}$ of about 4 mm to about 14 mm, and the heel constant thickness zone 634 a maximum width $w_{hm}$ of about 4 mm to about 14 mm. Preferably, $w_{tm} \geq w_{cm} \geq w_{hm}$.

The central constant thickness zones 630, 632 and 634 are separated by two central transition zones 640. The central transition zones 640 may have a width $w_{ctz}$ between about 0.5 mm and about 6 mm, and may either be a constant width, as shown, or alternatively, may have a variable width along their vertical length. Preferably, as shown, the central transition zones 640 extend from the top edge 636 to the bottom edge 638 of the thickened central region 620. Moreover, in this embodiment the center constant thickness zone 630 has vertical boundaries 642 that are substantially vertical and straight. Preferably, the horizontal centers of the two outer central thickness zones 632, 634 are located within about 0.5 inch of the face center 614. The thickened central region 620 has a geometric shape that substantially resembles or mimics the geometry of the striking face perimeter 625 and is scaled about the geometric center 614 of the striking face 602. In this current exemplary embodiment of the present invention shown in FIGS. 6A-C, it can be seen that although the geometry of the central perimeter 621 of the thickened central region 620 may not be identical to the face perimeter 625 of the striking face 602, it can still be considered to be substantially resembling without departing from the scope and content of the present invention. More specifically, the term "substantially similar" as defined by the current invention does not require one hundred percent congruence, but only that the shapes loosely resemble one another.

It will be appreciated that the central thickened region 620 with the central constant thickness zones 630, 632 and 634 balances CT across the striking face 602. For example, preferably the CT at the toe and heel are within 1% of the CT at the center of the thickened central region 620. In this example, the center constant thickness zone 630 has a $CT_c$ of about 244, while the toe constant thickness zone 632 has a $CT_t$ of about 245, and the heel constant thickness zone 634 has a $CT_h$ of about 244.

Moreover, as shown in FIGS. 6A-C, the intermediate transition region 622 encompasses the thickened central region 620 and has an intermediate transition perimeter 623 and an outer perimeter region 624 encompassing the intermediate transition region 622. As shown, the encompassing intermediate transition region 622 may have a width and the width $w_c$ adjacent the crown portion 606 may be greater than the width $w_s$ adjacent the sole portion 608. For example, the transition region may have a width $w_c$ of about 4 mm to about 10 mm adjacent the crown and a width $w_s$ adjacent the sole about 4 mm to about 10 mm adjacent the sole. As discussed above, the intermediate transition region 622 has a geometric shape that also substantially resembles or mimics the geometry of the striking face perimeter 625. It will be appreciated from FIGS. 6A-C that the intermediate transition region 622 has a height h that is about 50 to 90%, more preferably 60 to 80% of the overall height H of the striking face 602. Moreover, the center 646 of the intermediate transition region 622 is translated upward relative to face center 614 by about 15%, preferably by about 7 mm. This translation of the intermediate transition zone 622 upward assists in balancing the stress on the striking face 602 between high and low hits on the striking face 602. It will be appreciated that the outer perimeter region 624 may include outer perimeter constant thickness zones 648, 650, 652 and 654 and outer perimeter transition zones 656, 658, 660, 662 as described above. Alternatively, the outer perimeter region 624 may be a region of generally constant thickness. As discussed above, it will be appreciated that the striking face 602 may have any number of outer perimeter constant thickness zones and corresponding outer perimeter transition zones.

Figure 7A:
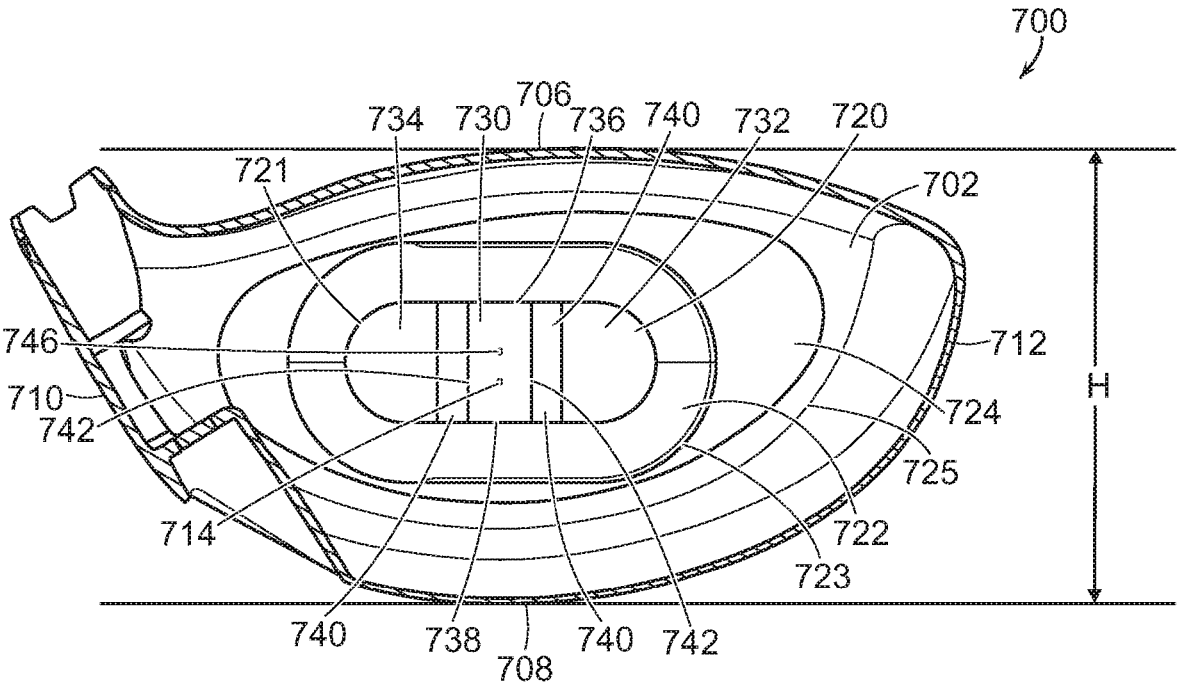
FIG. 7A shows a rear view of a cut-open golf club head that illustrates the striking face in accordance with another exemplary embodiment of the present invention.
Figure 7B:
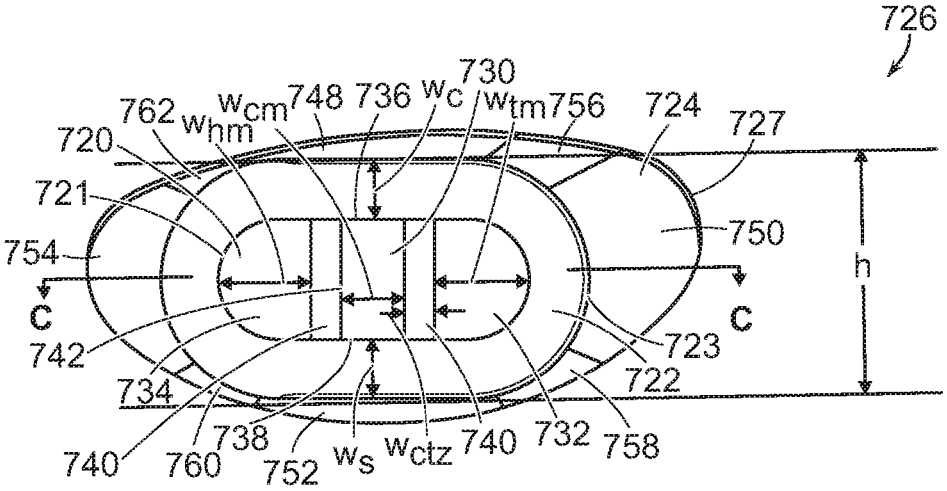
FIG. 7B shows a rear view of the striking face insert of FIG. 7A taken along cross-sectional line B-B that illustrates the striking face in accordance with an exemplary embodiment of the present invention.
Figure 7C:
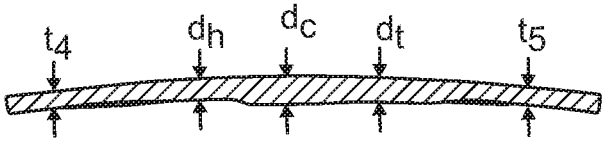
FIG. 7C shows a cross-sectional view of the striking face insert of FIG. 7B taken along cross-sectional line C-C that illustrates the striking face in accordance with an exemplary embodiment of the present invention.

FIGS. 7A-C show yet another alternative embodiment of the striking face 702 for club head 700. A golf club head 700 has been cut open to illustrate the rear portion of the striking face 702. It will be appreciated from the prior embodiments that the golf club head 700 generally has a crown portion 706, a sole portion 708, a heel portion 710 and a toe portion 712. Striking face 702, as shown in FIGS. 7A-C, may generally have a thickened central region 720 having a central perimeter 721, an intermediate transition region 722 having an intermediate transition perimeter 723, and an outer perimeter region 724 having an outer perimeter 725. As shown previously, the face insert 726 has an outer boundary 727. The striking face 702 includes the thickened central region 720. In this embodiment, the thickened central region 720 has a regular rectangular shape with rounded ends and is not shaped to follow the contour of the striking face 702 of the club head 700 as in the prior two embodiments. The thickened central region 720 features three constant thickness zones 730, 732, 734. Preferably, the three constant thickness zones 730, 732, 734 extend vertically within the thickened central region 720 from a top edge 736 to a bottom edge 738 of the thickened central region 720. It will be appreciated that at least one of the at least three central constant thickness zones 730, 732, 734 includes the thickest part of the striking face 702. Preferably, the thickest part of the striking face 702 is the center constant thickness zone 730 of the thickened central region 720. The thickened central region 720 comprises between about 10% to about 20%, more preferably at least 15%, of the overall striking face 702 enclosed by the face perimeter 725. As shown, preferably the central constant thickness zone 730 is centered on face center 714 and is sized to be about 5% to about 10%, more preferably 7% of the overall face area defined by the face perimeter 725. Moreover, the center constant thickness zone 730 has a thickness $d_c$ of greater than about 2.5 mm, preferably about 3 mm to about 4.5 mm, more preferably greater than or equal to 3.2 mm. Moreover, the toe constant thickness zone 732 has a thickness $d_t$, of greater than about 2.5 mm, preferably about 3 mm to about 4 mm, more preferably greater than or equal to 3.2 mm. Additionally, the heel constant thickness zone 734 has a thickness $d_h$ of greater than about 2.0 mm, preferably about 2.4 mm to about 3.4 mm, more preferably greater than or equal to 2.5 mm. Preferably, $d_c>d_t\geq d_h$. In this particular embodiment shown, the center constant thickness zone 730 has a thickness $d_c$ of about 3.6 mm, the toe constant thickness zone 732 has a thickness $d_t$ of about 3.3 mm and the heel constant thickness zone 734 has a thickness $d_h$ of about 2.7 mm. Moreover, it will be appreciated that each central constant thickness zone 730, 732 and 734 has a maximum width. Preferably, the center constant thickness zone 730 has a maximum width $w_{cm}$ of about 3 mm to about 13 mm, the toe constant thickness zone 732 a maximum width $w_{tm}$ of about 4 mm to about 14 mm, and the heel constant thickness zone 734 a maximum width $w_{hm}$ of about 4 mm to about 14 mm. Preferably, $w_{tm}>w_{cm}>w_{hm}$.

The central constant thickness zones 730, 732 and 734 are separated by two central transition zones 740. The central transition zones 740 may have a width $w_{ctz}$ between about 0.5 mm and about 6 mm, and may either be a constant width, as shown, or alternatively, may have a variable width along their vertical length. Preferably, as shown, the central transition zones 740 extend from the top edge 736 to the bottom edge 738 of the thickened central region 720. Moreover, in this embodiment the center constant thickness zone 730 has vertical boundaries 742 that are substantially straight. Preferably, the horizontal centers of the two outer central thickness zones 732, 734 are located within about 0.5 inch of the face center 714.

The intermediate transition region 722 encompasses the thickened central region 720 and has an outer perimeter region 724 encompassing the intermediate transition region 722 with a center 746 of the intermediate transition region 722. As shown, the encompassing intermediate transition region 722 may have a width and the width $w_c$ adjacent the crown portion 706 may be the same as the width $w_s$ adjacent the sole portion 708. The width $w_c$, $w_s$ may be about 4 mm to about 10 mm, and preferably about 7.8 mm. It will be appreciated from FIGS. 7A-C that the intermediate transition region 722 has a height h that is about 50 to 90%, more preferably 60 to 80% of the overall height H of the striking face 702. It will be appreciated that the outer perimeter region 724 may include outer perimeter constant thickness zones 748, 750, 752 and 754 and outer perimeter transition zones 756, 758, 760, 762 as described above. Alternatively, the outer perimeter region 724 may be a region of generally constant thickness. As discussed above, it will be appreciated that the striking face 702 may have any number of outer perimeter constant thickness zones and corresponding outer perimeter transition zones.

Figure 8A:
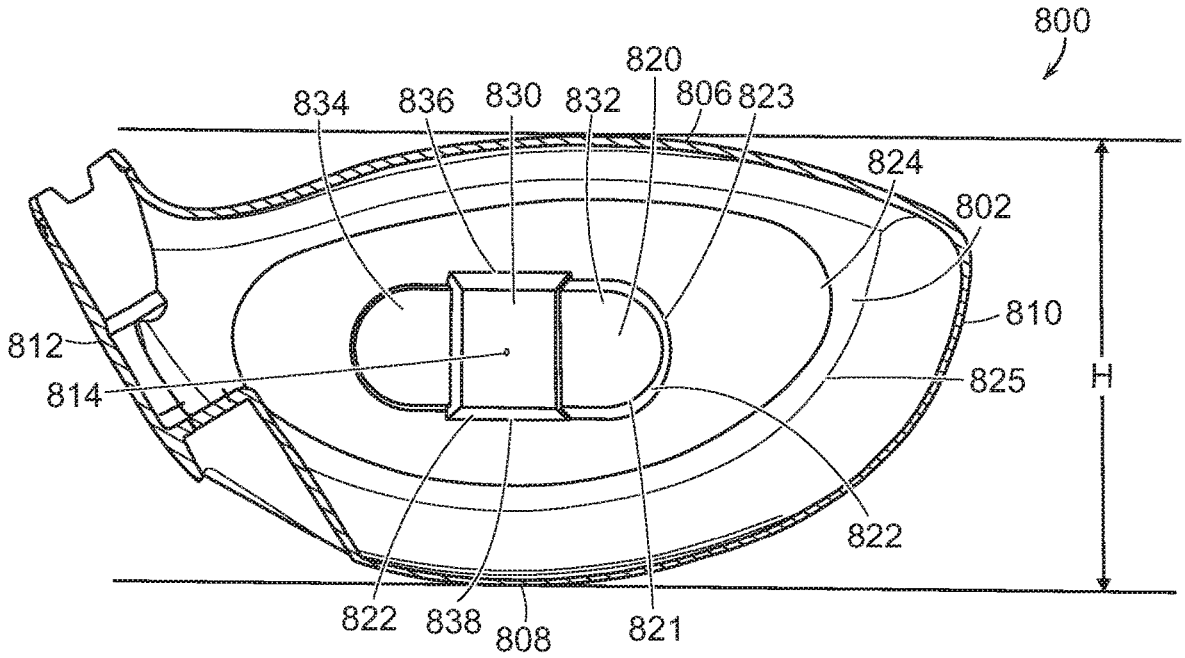
FIG. 8A shows a rear view of a cut-open golf club head that illustrates the striking face in accordance with another exemplary embodiment of the present invention.
Figure 8B:
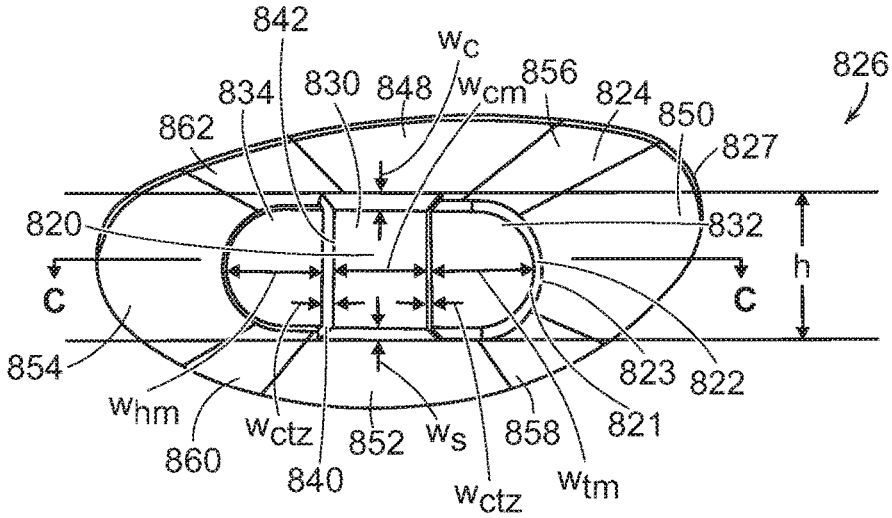
FIG. 8B shows a rear view of the striking face insert of FIG. 8A taken along cross-sectional line B-B that illustrates the striking face in accordance with an exemplary embodiment of the present invention.
Figure 8C:
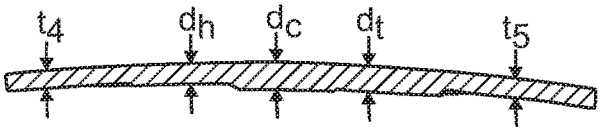
FIG. 8C shows a cross-sectional view of the striking face insert of FIG. 8B taken along cross-sectional line C-C that illustrates the striking face in accordance with an exemplary embodiment of the present invention.

FIGS. 8A-C show yet another embodiment of the present invention. A golf club head 800 has been cut open to illustrate the rear portion of the striking face 802. It will be appreciated from the prior embodiments that the golf club head 800 generally has a crown portion 806, a sole portion 808, a heel portion 810 and a toe portion 812. Striking face 802, as shown in FIGS. 8A-C, may generally have a thickened central region 820 having a central perimeter 821, an intermediate transition region 822 having an intermediate transition perimeter 823, and an outer perimeter region 824 having an outer perimeter 825. As shown previously, the face insert 826 has an outer boundary 827. It will be appreciated that thickened central region 820 in this embodiment features three constant thickness zones 830, 832, 834. Preferably, the three constant thickness zones 830, 832, 834 extend vertically within the thickened central region 820 from a top edge 836 to a bottom edge 838 of the thickened central region 820. It will be appreciated that at least one of the at least three central constant thickness zones 830, 832, 834 includes the thickest part of the striking face 802. Preferably, the center constant thickness zone 830 is the thickest part of the striking face 802 and is centered on face center 814. The thickened central region 820 comprises between about 10% to about 20% of the overall striking face 802 enclosed by the face perimeter 825. As shown, preferably the central constant thickness zone 830 is centered on face center 814 and is sized to be about 5% to about 10%, more preferably 7% of the overall face area defined by the face perimeter 825. Moreover, the center constant thickness zone 830 has a thickness $d_c$ of greater than about 2.5 mm, preferably about 3 mm to about 4.5 mm, more preferably greater than or equal to 3.2 mm. Moreover, the toe constant thickness zone 832 has a thickness $d_t$, of greater than about 2.5 mm, preferably about 3 mm to about 4 mm, more preferably greater than or equal to 3.2 mm. Additionally, the heel constant thickness zone 834 has a thickness $d_h$ of greater than about 2.0 mm, preferably about 2.4 mm to about 3.4 mm, more preferably greater than or equal to 2.5 mm. Preferably, $d_c>d_t\geq d_h$. In this particular embodiment shown, the center constant thickness zone 830 has a thickness $d_c$ of about 3.6 mm, the toe constant thickness zone 832 has a thickness $d_t$ of about 3.3 mm and the heel constant thickness zone 834 has a thickness $d_h$ of about 2.7 mm. Moreover, it will be appreciated that each central constant thickness zone 830, 832 and 834 has a maximum width. Preferably, the center constant thickness zone 830 has a maximum width $w_{cm}$ of about 3 mm to about 13 mm, the toe constant thickness zone 832 a maximum width $w_{tm}$ of about 4 mm to about 14 mm, and the heel constant thickness zone 834 a maximum width $w_{hm}$ of about 4 mm to about 14 mm. Preferably, $w_{tm} \geq w_{cm} \geq w_{hm}$.

Moreover, the two outer central thickness zones 832, 834 are separated from the central thickness zone by a central transition zones 840. The central transition zones 840 may have a width $w_{ctz}$ between about 0.5 mm and about 6 mm. As shown, the central transition zones 840 are a constant width $w_{ctz}$, although it will be appreciated that they may be a variable width. In this embodiment, the intermediate transition region 822 also surrounds the thickened central region 820. The portion of the intermediate transition region 822 surrounding each constant thickness zone 830, 832, 834 has a different width. In this embodiment, the intermediate transition zone 822 has a width at the center greater than the width at the toe, which is greater than the width at the heel. In this embodiment, the intermediate transition region 822 has a width $w_c$, $w_s$ of about 0.5 mm to about 10 mm, preferably 0.5 mm to 2 mm. Preferably the horizontal centers of the two outer central thickness zones 832, 834 are located within about 0.5 inch of the face center 814. It will be appreciated from FIGS. 8A-C that the intermediate transition region 822 has a height h that is about 50 to 90%, more preferably 50 to 70% of the overall height H of the striking face 802. It will be appreciated that the outer perimeter region 824 may include outer perimeter constant thickness zones 848, 850, 852 and 854 and outer perimeter transition zones 856, 858, 860, 862 as described above. Alternatively, the outer perimeter region 824 may be a region of generally constant thickness. As discussed above, it will be appreciated that the striking face 802 may have any number of outer perimeter constant thickness zones and corresponding outer perimeter transition zones.

Figure 9A:
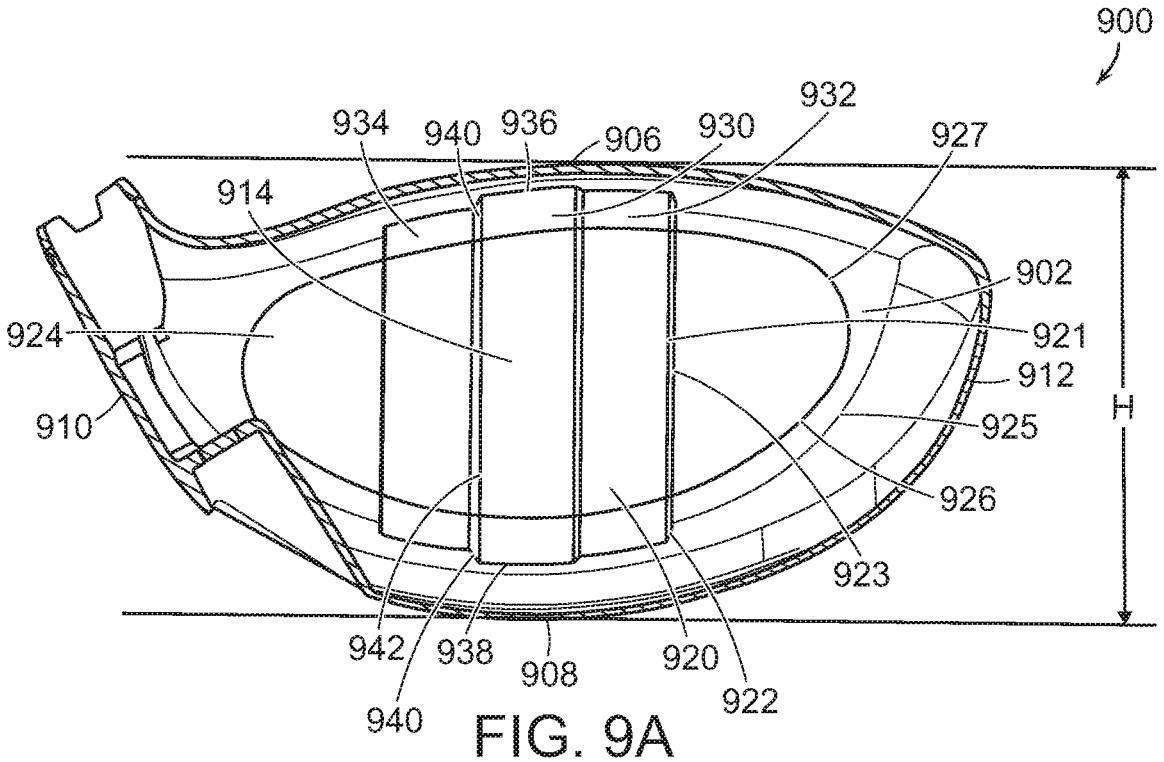
FIG. 9A shows a rear view of a cut-open golf club head that illustrates the striking face in accordance with another exemplary embodiment of the present invention.
Figure 9B:
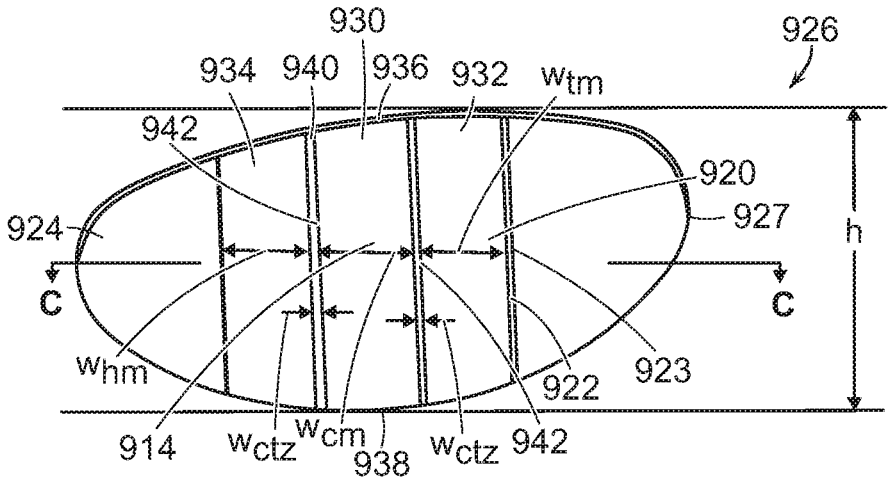
FIG. 9B shows a rear view of the striking face insert of FIG. 9A taken along cross-sectional line B-B that illustrates the striking face in accordance with an exemplary embodiment of the present invention.
Figure 9C:
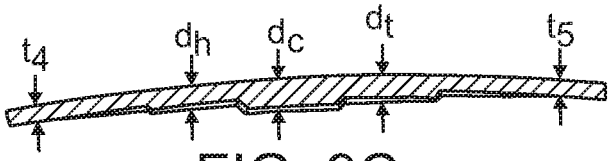
FIG. 9C shows a cross-sectional view of the striking face insert of FIG. 9B taken along cross-sectional line C-C that illustrates the striking face in accordance with an exemplary embodiment of the present invention.

FIGS. 9A-C of the accompanying drawings show a rear view of a golf club head in accordance with an alternative embodiment of the present invention with a golf club head 900 that has been cut open to illustrate the rear portion of the striking face 902. It will be appreciated from the prior embodiments that the golf club head 900 generally has a crown portion 906, a sole portion 908, a heel portion 910 and a toe portion 912. Striking face 902, as shown in FIGS. 9A-C, may generally have a thickened central region 920 having a central perimeter 921, an intermediate transition region 922 having an intermediate transition perimeter 923, and an outer perimeter region 924 having an outer perimeter 925. As shown previously, the face insert 926 has an outer boundary 927. The thickened central region 920 has a geometric shape that extends from the crown portion 906 to the sole portion 908 of the club head 900. It will be appreciated that thickened central region 920 in this embodiment features three constant thickness zones 930, 932, 934. Preferably, the three constant thickness zones 930, 932, 934 extend vertically within the thickened central region 920 from the top edge 936 to bottom edge 938 of the thickened central region 920. It will be appreciated that at least one of the at least three central constant thickness zones 930, 932, 934 includes the thickest part of the striking face 902. Preferably, the center thickness zone 930 is the thickest portion of the striking face 902. The thickened central region 920 comprises between about 10% to about 50% of the overall striking face portion enclosed by the face perimeter 925. As shown, preferably the center constant thickness zone 930 is centered on face center 914 and is sized to be about 15% to about 21%, more preferably 18% of the overall face area defined by the face perimeter 925. The center constant thickness zone 930 has a thickness $d_c$ of at least 2.5 mm, more preferably about 3 mm to about 4.5 mm, and most preferably at least 3.2 mm. Moreover, the toe constant thickness zone 932 has a thickness $d_t$, of greater than about 2.5 mm, preferably about 3 mm to about 4 mm, more preferably greater than or equal to 2.9 mm. Additionally, the heel constant thickness zone 934 has a thickness $d_h$ of greater than about 2.0 mm, preferably about 2.4 mm to about 3.4 mm, more preferably greater than or equal to 2.5 mm. Preferably, Preferably, $d_c > d_t \geq d_h$. In this particular embodiment shown, the center constant thickness zone 930 has a thickness $d_c$ of about 3.6 mm, the toe constant thickness zone 932 has a thickness $d_t$ of about 2.9 mm and the heel constant thickness zone 934 has a thickness $d_h$ of about 2.5 mm. Moreover, it will be appreciated that each central constant thickness zone 930, 932 and 934 has a maximum width. Preferably, the center constant thickness zone 930 has a maximum width $w_{cm}$ of about 3 mm to about 13 mm, the toe constant thickness zone 932 a maximum width $w_{tm}$ of about 4 mm to about 14 mm, and the heel constant thickness zone 934 a maximum width $w_{hm}$ of about 4 mm to about 14 mm. Preferably, the widths are substantially equal to each other.

Moreover, the two outer central thickness zones 932, 934 are separated by two central transition zones 940. The central transition zones 940 may have a width $w_{ctz}$ between about 0.5 mm and about 6 mm, and may either be a constant width, as shown, or alternatively, may vary in width. Preferably, as shown, the central transition zones 940 extend from the top edge 936 to the bottom edge 938 of the thickened central region 920 adjacent the three constant thickness zones 930, 932, 934. Moreover, in this embodiment the center thickened zone 930 has vertical boundaries 942 that are substantially straight, although it will be appreciated that they may be curved. Preferably, the horizontal centers of the two outer central thickness zones 932, 934 are located within about 0.5 inch of the face center 914. The intermediate transition region 922 is provided on the vertical boundaries 942 of the toe constant thickness zone 932 and heel constant thickness zone 934 and has a width of about 0.5 mm to about 10 mm, preferably about 0.5 mm to about 2 mm. It will be appreciated from FIGS. 9A-C that the intermediate transition region 922 has a height h that is about 50 to 90%, more preferably 70 to 90% of the overall height H of the striking face 902. The outer perimeter region 924 is provided adjacent the toe portion 912 and heel portion 910 of the striking face 902. In this embodiment the outer perimeter region 924 is provided with a constant thickness.

Figure 10A:
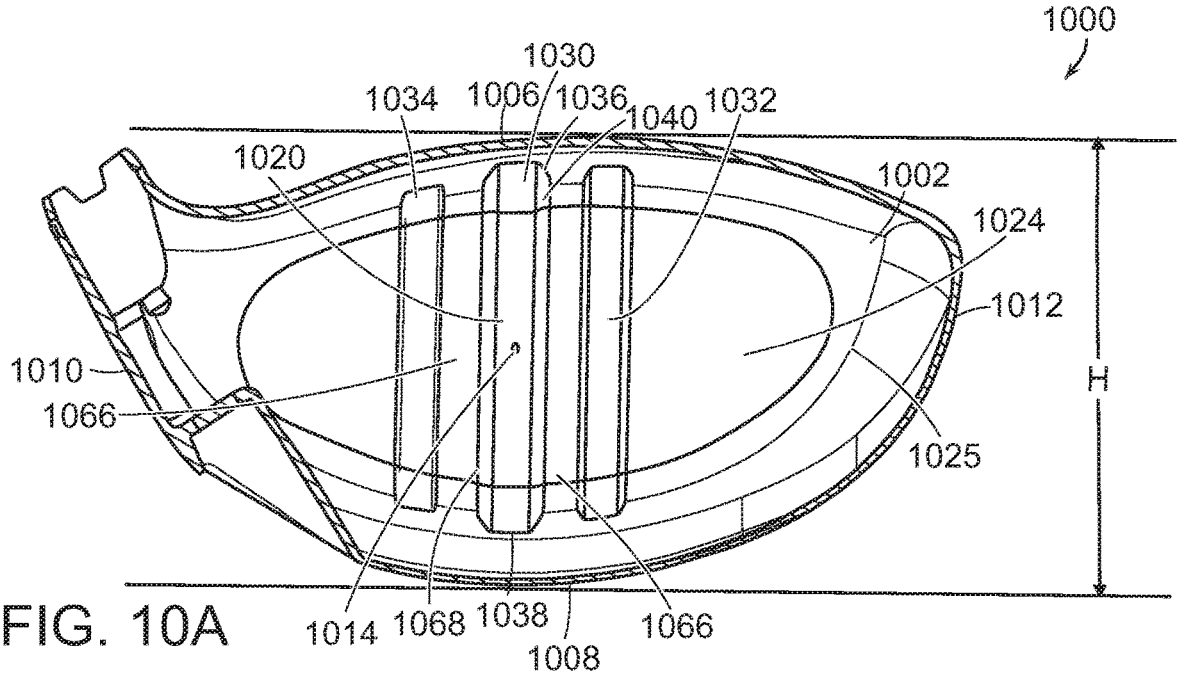
FIG. 10A shows a rear view of a cut-open golf club head that illustrates the striking face in accordance with yet another exemplary embodiment of the present invention.
Figure 10B:
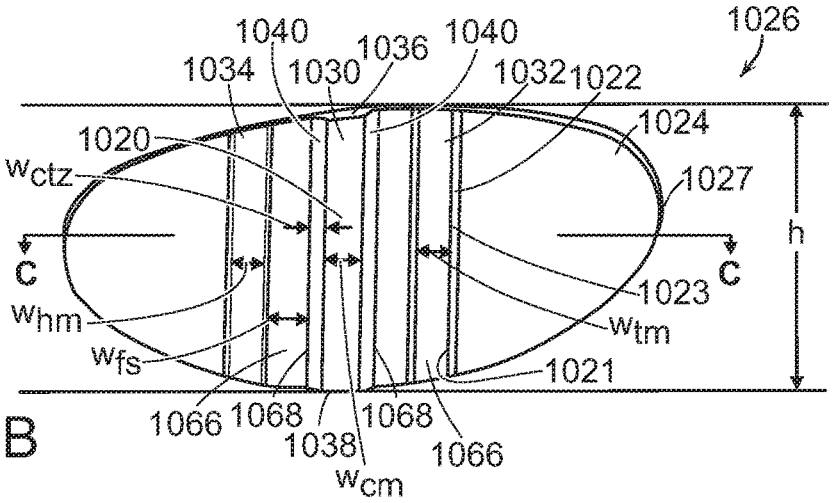
FIG. 10B shows a rear view of the striking face insert of FIG. 10A taken along cross-sectional line B-B that illustrates the striking face in accordance with an exemplary embodiment of the present invention.
Figure 10C:
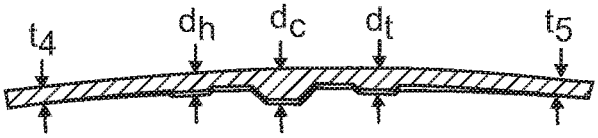
FIG. 10C shows a cross-sectional view of the striking face insert of FIG. 10B taken along cross-sectional line C-C that illustrates the striking face in accordance with an exemplary embodiment of the present invention.

FIGS. 10A-C of the accompanying drawings show a rear view of a golf club head in accordance with an alternative embodiment of the present invention with a golf club head 1000 that has been cut open to illustrate the rear portion of the striking face 1002. It will be appreciated from the prior embodiments that the golf club head 1000 generally has a crown portion 1006, a sole portion 1008, a heel portion 1010 and a toe portion 1012. Striking face 1002, as shown in FIGS. 10A-C, may generally have a thickened central region 1020 having a central perimeter 1021, an intermediate transition region 1022 having an intermediate transition perimeter 1023, and an outer perimeter region 1024 having an outer perimeter 1025. As shown previously, the face insert 1026 has an outer boundary 1027. The thickened central region 1020 has a geometric shape that extends from the crown portion 1006 to the sole portion 1008 of the club head 1000. It will be appreciated that thickened central region 1020 in this embodiment features three constant thickness zones 1030, 1032, 1034. Preferably, the three constant thickness zones 1030, 1032, 1034 extend vertically within the thickened central region 1020 from a top edge 1036 to a bottom edge 1038 of the thickened central region 1020. It will be appreciated that at least one of the at least three central constant thickness zones 1030, 1032, 1034 includes the thickest part of the striking face portion 1002. Preferably, the center constant thickness zone 1030 has the thickest portion of the striking face 1002. The thickened central region 1020 comprises between about 5% to about 8% of the overall striking face portion enclosed by the face perimeter 1025. As shown, preferably the center constant thickness zone 1030 is centered on face center 1014 and is sized to be about 5% to about 10%, more preferably 7% of the overall face area defined by the face perimeter 1025. The center constant thickness zone 1030 has a thickness $d_c$ of at least 2.5 mm, more preferably about 3 mm to about 4.5 mm, and most preferably at least 3.2 mm. Moreover, the toe constant thickness zone 1032 has a thickness $d_t$, of greater than about 2.5 mm, preferably about 3 mm to about 4.0 mm, more preferably greater than or equal to 3.0 mm. Additionally, the heel constant thickness zone 1034 has a thickness $d_h$ of greater than about 2.0 mm, preferably about 2.4 mm to about 3.4 mm, more preferably greater than or equal to 2.5 mm. Preferably, $d_c > d_t \geq d_h$. In this particular embodiment shown, the center constant thickness zone 1030 has a thickness $d_c$ of about 4.3 mm, the toe constant thickness zone 1032 has a thickness $d_t$ of about 3.0 mm and the heel constant thickness zone 1034 has a thickness $d_h$ of about 2.6 mm. Moreover, it will be appreciated that each central constant thickness zone 1030, 1032 and 1034 has a maximum width. Preferably, the center constant thickness zone 1030 has a maximum width $w_{cm}$ of about 3 mm to about 13 mm, the toe constant thickness zone 1032 a maximum width $w_{tm}$ of about 4 mm to about 14 mm, and the heel constant thickness zone 1034 a maximum width $w_{hm}$ of about 4 mm to about 14 mm. Preferably, the widths are substantially equivalent. Moreover, the two outer central thickness zones 1032, 1034 are separated by four central transition zones 1040 and two face sections 1066. The central transition zones 1040 may have a width $w_{ctz}$ between about 0.5 mm and about 6 mm, and may either be a constant width, as shown, or alternatively, may vary in width. Preferably, as shown, the central transition zones 1040 extend from the top edge 1036 to the bottom edge 1038 of the thickened central region 1020. The face sections 1066 separating the constant thickness zones 1030, 1032, 1034 of the thickened central region 1020 may have a width $w_{fs}$ between about 4 mm and about 6 mm. The vertical edges 1068 of the face sections 1066 are shown as extending straight from the crown portion 1006 to the sole portion 1008; however, it will be appreciated that the edges 1068 may be curved and therefore the width $w_{fs}$ may be varied along its length. Preferably, the horizontal centers of the two outer central thickness zones 1032, 1034 are located within about 1 inch of the face center 1014. The intermediate transition region 1022 is provided on the outer edges 1068 of the toe constant thickness zone 1032 and heel constant thickness zone 1034 and has a width of about 1 mm to about 2 mm. It will be appreciated from FIGS. 10A-C that the intermediate transition region 1022 has a height h that is about 50 to 90%, more preferably 70 to 90% of the overall height H of the striking face 1002. The outer perimeter region 1024 is provided adjacent the heel portion 1010 and toe portion 1012 of the striking face 1002. In this embodiment the outer perimeter region 1024 is provided with a constant thickness.

Figure 11A:
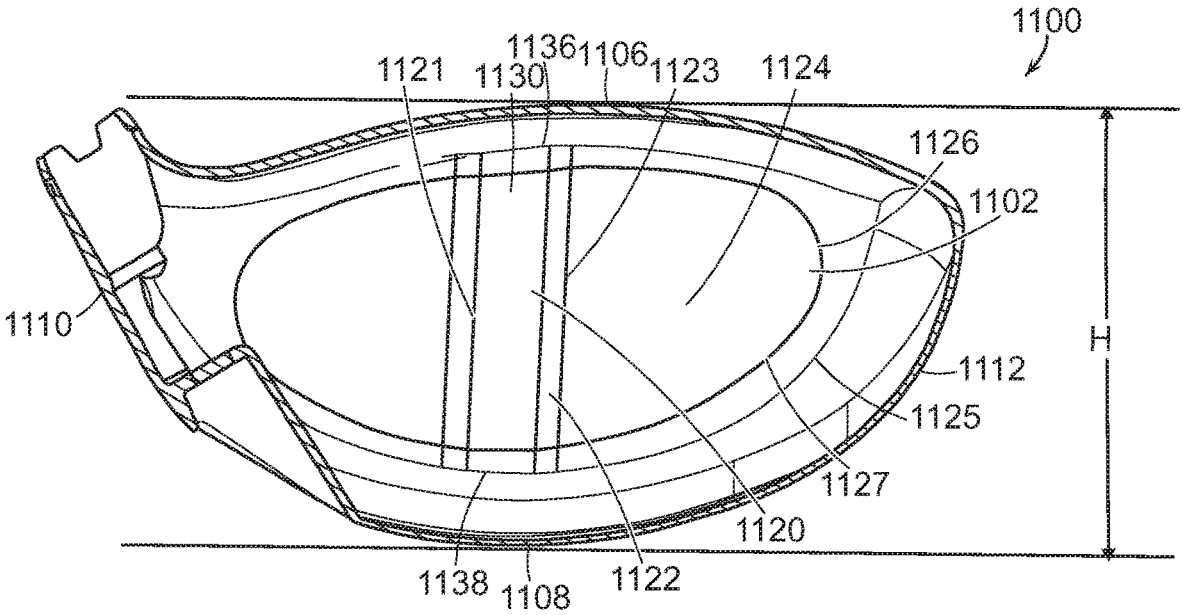
FIG. 11A shows a rear view of a cut-open golf club head that illustrates the striking face in accordance with another exemplary embodiment of the present invention.
Figure 11B:
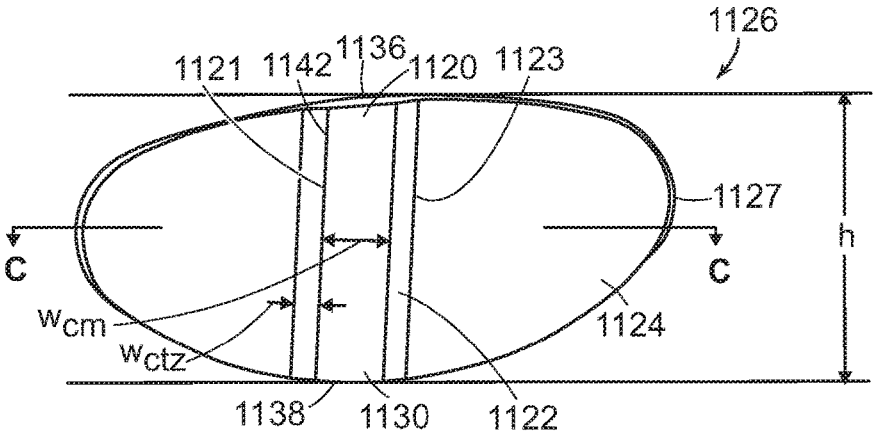
FIG. 11B shows a rear view of the striking face insert of FIG. 11A taken along cross-sectional line B-B that illustrates the striking face in accordance with an exemplary embodiment of the present invention.
Figure 11C:
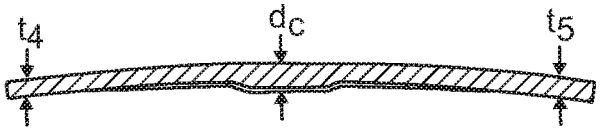
FIG. 11C shows a cross-sectional view of the striking face insert of FIG. 11B taken along cross-sectional line C-C that illustrates the striking face in accordance with an exemplary embodiment of the present invention.

FIGS. 11A-C of the accompanying drawings show a rear view of a golf club head 1100 in accordance with an alternative embodiment of the present invention with a golf club head 1100 that has been cut open to illustrate the rear portion of the striking face 1102. It will be appreciated from the prior embodiments that the golf club head 1100 generally has a crown portion 1106, a sole portion 1108, a heel portion 1110 and a toe portion 1112. Striking face 1102, as shown in FIGS. 11A-C, may generally have a thickened central region 1120 having a central perimeter 1121, an intermediate transition region 1122 having an intermediate transition perimeter 1123, and an outer perimeter region 1124 having an outer perimeter 1125. As shown previously, the face insert 1126 has an outer boundary 1127. The thickened central region 1120 has a geometric shape that extends from the crown portion 1106 to the sole portion 1108 of the club head 1100. It will be appreciated that thickened central region 1120 in this embodiment features one constant thickness zone 1130. Preferably, the constant thickness zone 1130 extends vertically within the thickened central region 1120 from the top edge 1136 to a bottom edge 1138 of the thickened central region 1120. It will be appreciated that the center constant thickness zone 1130 forms a center that includes the thickest part of the striking face 1102. The center constant thickness zone 1130 comprises between about 11% to about 16% of the overall striking face 1102 enclosed by the face perimeter 1125. The center constant thickness zone 1130 has a thickness $d_c$ of at least 2.5 mm, preferably about 3 mm to about 4.5 mm, and more preferably greater than or equal to 3.2 mm. In this particular embodiment, $d_c$ is about 3.4 mm. Additionally, the center constant thickness zone 1130 has a maximum width $w_{cm}$ between about 4 mm and 6 mm. It will be appreciated that although the width is shown as being constant from the crown portion 1106 to the sole portion 1108 with boundaries 1142 being substantially vertical and straight, the width may be variable along the length of the constant thickness zone 1130 such that the boundaries are curved along their length. The intermediate transition region 1122 is provided adjacent the vertical boundaries 1142 of the center constant thickness zone 1130 and have a width $w_{ctz}$ of about 0.5 mm to about 6 mm. It will be appreciated from FIGS. 11A-C that the intermediate transition region 1122 has a height h that is about 50 to 90%, more preferably 70 to 90% of the overall height H of the striking face 1102. The outer perimeter region 1124 is provided adjacent the heel portion 1110 and toe portion 1112 of the striking face 1102. In this embodiment the outer perimeter region 1124 is provided with a constant thickness.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of the golf club head adapted to strike a golf ball, the striking face portion having a face perimeter and a back surface; and a body portion connected to an aft portion extending from the face perimeter of the striking face portion;

the striking face portion further comprising, a thickened central region having a central perimeter and at least three central constant thickness zones provided in the central region within the central perimeter, each central constant thickness zone having a maximum length and a different thickness, the three central constant thickness zones including a middle central constant thickness zone provided between the other two central constant thickness zones, the middle central constant thickness zone having a maximum length that is greater than the maximum lengths of the other central constant thickness zones, an intermediate transition region immediately encompassing the thickened central region and having an intermediate transition perimeter, wherein a thickness of the intermediate transition region begins decreasing at the central perimeter, and wherein the at least three central constant thickness zones abut the central perimeter, and an outer perimeter region immediately encompassing the intermediate transition region and having at least four outer perimeter constant thickness zones.

2. The golf club head of claim 1, further comprising at least two central transition zones separating the at least three central constant thickness zones.

3. The golf club head of claim 2, wherein the two central transition zones separating the at least three constant central thickness zones have a width of about 1 mm to about 4 mm.

4. The golf club head of claim 2, wherein the at least three central constant thickness zones extend vertically within the thickened central region.

5. The golf club head of claim 4, wherein the middle central constant thickness zone has a middle central constant thickness zone perimeter having vertical boundaries that are curved to form a substantially hourglass shape for the middle central constant thickness zone.

6. The golf club head of claim 1, wherein the at least four outer perimeter constant thickness zones are provided extending from the intermediate transition perimeter towards a crown region, a sole region, a heel region and a toe region of the club head to the face perimeter.

7. The golf club head of claim 6, wherein the at least four outer perimeter constant thickness zones are separated by at least four outer perimeter transition zones extending from the intermediate transition perimeter towards the face perimeter.

8. The golf club head of claim 1, wherein the thickened central region comprises between about 10 to about 20 percent of the overall striking face portion enclosed by the face perimeter.

9. The golf club head of claim 1, wherein the middle central constant thickness zone includes the thickest part of the striking face portion.

10. The golf club head of claim 9, wherein the middle central constant thickness zone is about 4 to about 10 percent of the overall striking face portion.

11. The golf club head of claim 10, wherein the encompassing intermediate transition region has a width and the width adjacent a crown portion is greater than the width adjacent a sole portion.

12. The golf club head of claim 1, wherein the outer perimeter constant thickness zones and outer perimeter transition zones radiate outwardly from the encompassing intermediate transition region to the face perimeter.

13. The golf club head of claim 12, wherein the outer perimeter transition zones have a width of at least 4 mm adjacent to the encompassing intermediate transition region.

14. The golf club head of claim 13, wherein the outer perimeter constant thickness zones and outer perimeter transition zones have substantially straight edges.

15. The golf club head of claim 1, wherein the edges of the outer perimeter constant thickness zones and outer perimeter transition zones extend outward at about a 30 to about a 60 degree angle from an orthogonal plane.

16. The golf club of claim 1, wherein the face perimeter has a shape and the thickened central region substantially mimics the shape of the face perimeter and is scaled about the center of the striking face portion.

17. A golf club head comprising:

a striking face portion located at a frontal portion of the golf club head adapted to strike a golf ball, said striking face portion having a face perimeter and a rear surface;

a body portion connected to an aft portion extending from the face perimeter of the striking face portion;

at least seven constant thickness zones and at least five transition zones provided on the rear surface of the striking face portion, wherein at least three of the constant thickness zones are provided centrally on the rear surface of the striking face portion in a thickened central region, each constant thickness zone in the thickened central region having a maximum length and a different thickness, the at least three constant thickness zones provided in the thickened central region including a middle central constant thickness zone provided between two other central constant thickness zones, the middle central constant thickness zone having a maximum length that is greater than the maximum lengths of the other central constant thickness zones, and the at least three constant central thickness zones are provided in the thickened central region of the striking face portion and are encompassed by an intermediate transition zone, wherein a thickness of the intermediate transition region begins decreasing at a perimeter of the thickened central region, and wherein the at least three central constant thickness zones abut the central perimeter.

18. The golf club head of claim 17, wherein the at least three constant central thickness zones are separated by two central transition zones.

19. The golf club head of claim 17, wherein the thickened central region comprises between about 10 to about 20 percent of the overall striking face portion enclosed by the face perimeter.

20. The golf club head of claim 19, wherein the middle central constant thickness zone of the thickened central region includes the thickest part of the striking face portion.

21. The golf club head of claim 20, wherein the middle central constant thickness zone is about 4 to about 10 percent of the overall striking face portion enclosed by the face perimeter.

22. The golf club head of claim 21, wherein the encompassing intermediate transition zone has a width and the width adjacent a crown portion is greater than the width adjacent a sole portion.

23. The golf club head of claim 22, further comprising an outer perimeter zone provided outside the encompassing intermediate transition zone, wherein the outer perimeter zone provides at least four outer perimeter constant thickness zones and at least four outer perimeter transition zones separating the outer perimeter constant thickness zones.

* * * * *